US005743235A

United States Patent [19]

Lueder

[11] Patent Number: 5,743,235

[45] Date of Patent: Apr. 28, 1998

[54] MOLDED-IN WIRING FOR INTAKE MANIFOLDS

[76] Inventor: Lawrence Arimidio Lueder, 698 Bridgeton Pike, Mantua, N.J. 08051-1351

[21] Appl. No.: 753,264

[22] Filed: Nov. 22, 1996

[51] Int. Cl.[6] ..... F02M 55/02; F02M 35/10

[52] U.S. Cl. ..... 123/468; 123/184.61; 123/143 C; 123/470

[58] Field of Search ..... 123/184.61, 468, 123/469, 470, 456, 143 C

[56] References Cited

U.S. PATENT DOCUMENTS

| | | | |
|---|---|---|---|
| 2,488,096 | 11/1949 | Newman | 123/143 C |
| 2,509,093 | 5/1950 | Field | 123/143 C |
| 4,776,313 | 10/1988 | Freismuth et al. | 123/470 |
| 4,805,564 | 2/1989 | Hudson, Jr. | 123/184.61 |
| 5,003,933 | 4/1991 | Rush, II et al. | 123/184.61 |
| 5,163,406 | 11/1992 | Daly et al. | 123/184.61 |
| 5,189,782 | 3/1993 | Hickey | 123/470 |
| 5,209,204 | 5/1993 | Bodenhausen et al. | 123/456 |
| 5,211,149 | 5/1993 | DeGrace, Jr. | 123/470 |
| 5,218,936 | 6/1993 | Pritz et al. | 123/143 C |
| 5,295,468 | 3/1994 | Blessing et al. | 123/456 |
| 5,323,749 | 6/1994 | Gras et al. | 123/470 |
| 5,349,930 | 9/1994 | Maruyama et al. | 123/143 C |
| 5,353,767 | 10/1994 | Carbone et al. | 123/456 |
| 5,357,931 | 10/1994 | Semence | 123/470 |
| 5,447,140 | 9/1995 | Brisbane et al. | 123/456 |
| 5,598,824 | 2/1997 | Treusch et al. | 123/470 |

OTHER PUBLICATIONS

*Design News* Article Dated May 20, 1996, p. 53.

*Primary Examiner*—Thomas N. Moulis

[57] ABSTRACT

An internal combustion engine intake manifold with molded-in wiring and tubing. The manifold is intended to reduce assembly time and cost, increase reliability by eliminating as much as possible all external wiring and tubing that service sensors and controllers. All sensors, controllers and fuel injectors are installed using molded-in threaded fastener sockets.

13 Claims, 14 Drawing Sheets

MOLDED-IN WIRING FOR INTAKE MANIFOLDS

FIELD OF THE INVENTION

The invention relates generally to intake manifolds, in particular to a manifold that does away with all external wiring, wiring harness and tubing that services the manifold of internal combustion engines including piston and screw type engines.

BACKGROUND OF THE INVENTION

The existing automobile intake manifolds have been normally cast as one piece metal structures. All electrical components on the manifold are wired via electrical harnesses that are draped/arranged over the manifold. Vacuum hoses are also routed over to connect to various vacuum modules, diaphragms or other vacuum operated components.

Electrical wiring and rubber hoses are susceptible to heat breakdown, vibration, or from repeated maintenance requiring removal and reinstallation. Both vacuum hoses and electrical wiring could easily be reinstalled on the wrong sensor, fuel injector, etc. Unfortunately, these same problems translate into increased manufacturing service and assembly time/cost.

SUMMARY OF THE INVENTION

Accordingly, it is an object of the present invention to provide an intake manifold that decreases the number of external electrical wires.

Another object of the present invention is to provide an intake manifold that removes external tubing or a combination of both tubing and wiring. Other objects and advantages of the present invention will become more obvious hereinafter in the specification and drawings.

In accordance with the present invention, my invention is an intake manifold with molded in electrical wiring, vacuum passages/hoses and fuel line pressure tubing with any one of these combinations from an internal combustion engine. This invention is possible due to the recent change by Chrysler, General Motors and Ford to use nonferrous molded intake manifolds. These recently developed manifolds are manufactured in heat resistant plastic or fiberglass/resin composites. In particular a manifold manufactured with glass-fiber-reinforced type material has shown great promise for heat and chemical resistance and stability. By molding in the wiring and tubing it simplifies engine assembly time by reducing component mix up. Note: this design is not limited to plastic type castings but can also be adapted to metallic and composite type castings as well.

DETAILED DESCRIPTION OF THE INVENTION

Figure 1:
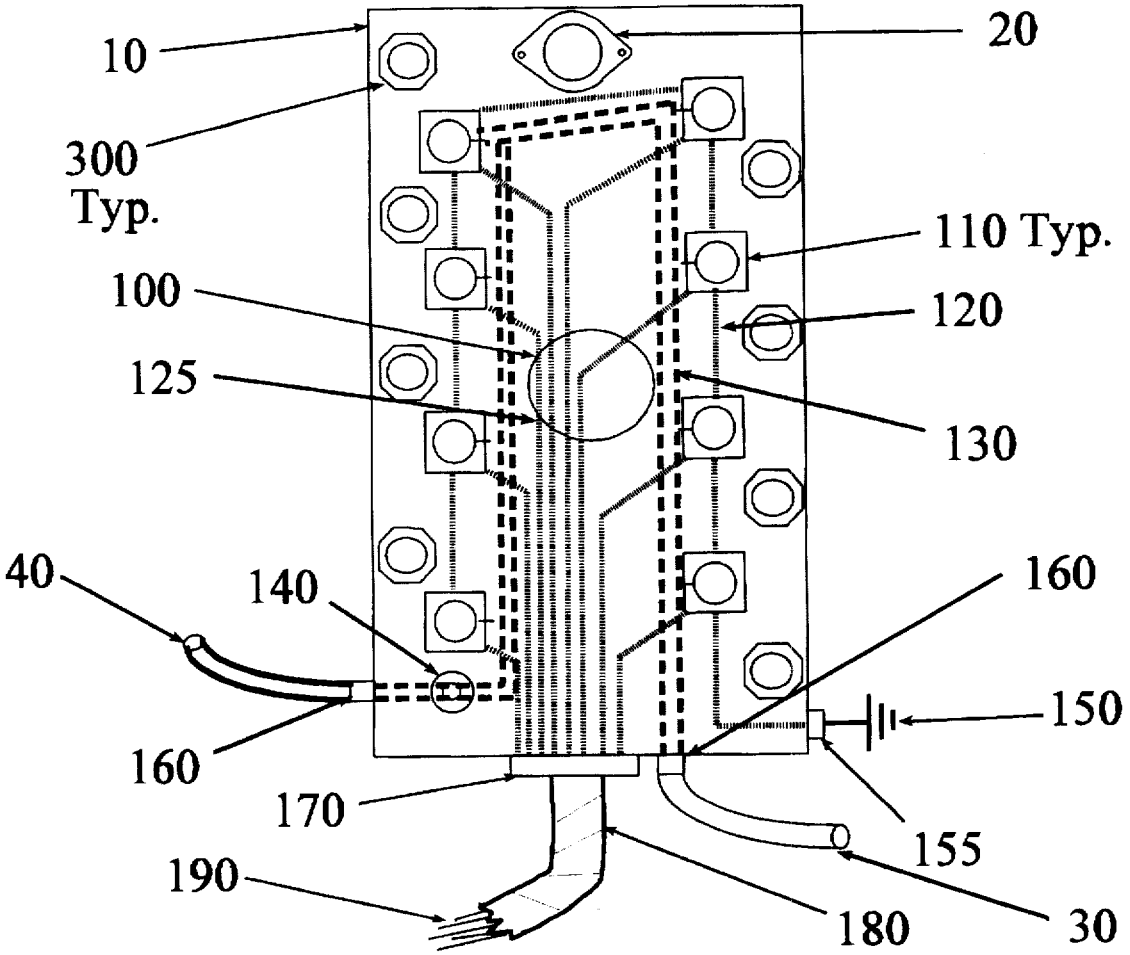
FIG. 1 is a top view block drawing of an intake manifold according to one embodiment of the present design illustrating a molded-in fuel injector system.

Referring now to the drawings, and more particularly to FIG. 1. One embodiment of manifold 10 is shown in top view. Manifold 10 consists of a casting designed per the various automobile industries specifically to deliver a fuel and air mixture to a piston or screw type, internal combustion engine. The specific details of the manifold 10 are not shown due to the many diverse models and configuration control privilege of the manufacturer. Manifold 10 details also omitted because this invention is about hidden wiring and tubing. The intent is to show in schematic or block diagram drawing what this molded-in wiring manifold might look like. FIG. 1, omits duplication of identifying/numbering every item that was previously identified/numbered to minimize clutter, for instance fuel injector socket 110 is numbered once with the label Typ. out of eight injectors depicted. Typ. is the abbreviations for the word typical. Specific individual component details regarding fastening techniques, plugging or connection methods are not shown due to the many possibilities. Each manufacturer will specify their own best method. Referring to FIG. 1 is a top view showing a reduced number of manifold components to minimize clutter, such as water flange connection 20, spark plug lug connections 300, air intake hole 100, and fuel injector sockets 110. Water flange connection 20 normally suggests the front end of an engine when referring to automobiles and the harness composed of 170, 180, and 190 is the back end. FIG. 1 is a block drawing top view of a typical eight cylinder automobile engine intake manifold. A manifold in this instance is an equipment item with several outlets for connecting one equipment item to several others, carburetor fuel/air mixture passages not shown for clarity. FIG. 1 fuel supply 115 flows through tubing 40 connected via various possible tube fittings 160 molded into service manifold 10. Molded-In tubing 130 routes the fuel from tube fitting 160 in a series mode to the various eight fuel injector sockets 110. Pressure relief valve socket 140 maintains fuel pressure at manufacturers predetermined specifications. The fuel pressure at the relief valve socket 140 can be regulated by: either electrical solenoid, motor or by vacuum control per manufactures specifications, not shown. The wiring and vacuum tubing if required servicing the relief valve socket 140 can be molded-in, not shown. Excess fuel 116 exits manifold 10 through fitting 160 and tubing 30. Electrical impulses/current is supplied to the fuel injector sockets 110 via wiring 190 woven through cable 180 that terminates at disconnect plug 170. The disconnect plugs can be either male or female per manufacturing preference. Two sections, male/female, of disconnect plug 170 details not shown for clarity. Molded-In wiring 125 picks up the electrical impulses and supplies the electrical impulses/current to the various fuel injector sockets 110. The fuel injector sockets 110 receive grounding through molded-in wire 120 that is a series connection from one fuel injector socket 110 to another and from one electrical component to another terminating at disconnect plug 155. The molded-in grounding wire 120 can also terminate at disconnect plug 170 and exit through cable 180, not shown. A cast metal manifold 10 with molded-in wiring would not require molded-in grounding wire 120 because it would rely on the casting body to perform that function. In such a case, the manifold 10 would only require a disconnect-plug 155 and grounding wire 150 to complete the circuit. My proposal is applicable to materials that produces or manufactures a manifold with molded-in electrical wiring or tubing to service any manifold component. By molded-in, I mean an intake manifold that has electrical wiring or tubing embedded. The wiring and tubing services components that are mechanically fastened to it, by mechanically fastened I mean similarly to any one of the many light bulb socket fastening or hydraulic hose connection methods. The wiring 120 or 125 need not necessarily be molded-in the manifold 10 casting. Another method for instance is by attachment with fasteners or inserted within a split multiple piece mold/casting manifold to appear molded-in, not shown. Wiring 120 or 125 can also be mechanically fastened within the manifold's 10 air/fuel passageways or mounted underneath to appear molded-in, not shown.

A fuel injector inserted in fuel injector socket 110 requires only a half-turn twist for electrical connections similar to Bayonet type light bulbs. A threaded connection would also suffice as well as screwed or bolted down method to insure electrical connections per each original equipment manufacturer (OEM) preference. The fuel injector socket 110 would require a thread type socket connection for molded-in fuel tubing/passages 130, similar to any one of the many types of tube fitting with appropriate preformed packing, O-rings, to prevent fuel leaks. Tube fittings also includes quick disconnect couplings that are typically used to couple hydraulic hoses. Pressure relief valve socket 140 receives pressurized fuel from molded-in tubing 130 and discharges the excess fuel, via disconnect fitting 160 and down through discharge tubing 30 per fuel direction arrow 116. The excess fuel returns to the fuel tank for recycling per OEM preference.

Fuel connection 160 to manifold 10 is fastened with appropriate fuel fittings molded-in the manifold 10. All connections on the manifold 10 can be either male or female in design. As an example, the electrical harness connection 170, the molded-in portion can be male or female. A surface mounted harness connection is another form where by, preformed packing, O-rings are used and the connections are secured with threaded fasteners or snap together hooks/jacks. A more radical method can also be used to connect the harness 170, 180 or 190 to the manifold 10 using free standing electrical or tubing connectors, not shown.

Figure 2:
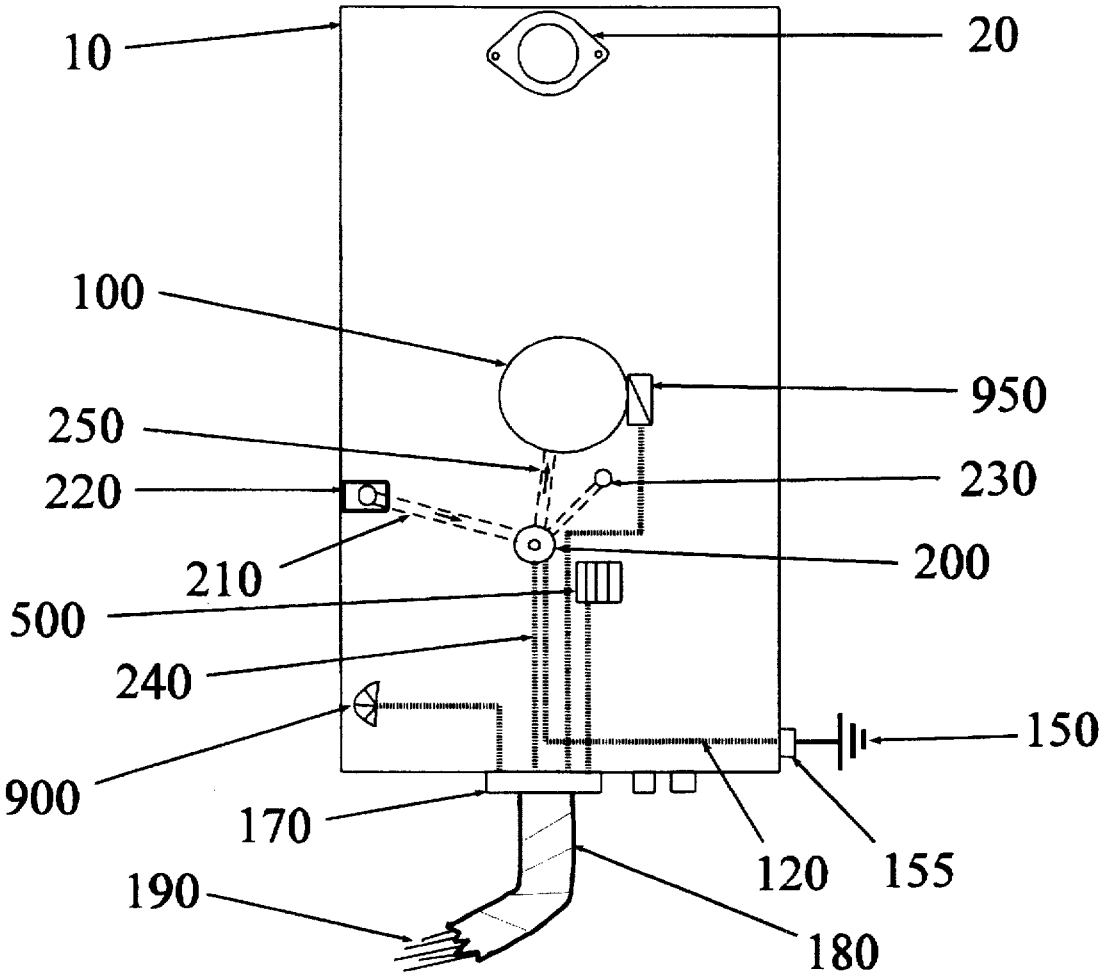
FIG. 2 is a top view block drawing showing a manifold according to another embodiment of the present design using an Exhaust Gas Recirculating (EGR) valve socket, Temperature, Pressure and Gas Sensor.

FIG. 2 is a top view of a molded-in wiring/tubing manifold 10. All brevity explanations per FIG. 1 specifications remain the same. FIG. 2, like FIG. 1, details only those items pertinent to a single manifold component system. That component, in this case, is an Exhaust Gas Recirculating valve socket 200 or (EGR as it's known in the automobile industry). Duplicate components are numbered once in FIG. 2 for clarity such as fuel injectors sockets 110. FIG. 2 shows one scenario of what an EGR socket 200 might look like if it was installed with molded-in wiring 120 and 240 or tubing 210, 230, and 250. Other wiring or tubing configurations are per OEM/manufacturer preference. EGR's are normally vacuum motor controlled valves and per molded-in tubing/passages 210, 230, and 250 illustrates how that might be accomplished. FIG. 2 is not to explain how an EGR valve works, rather to illustrate how it might look in schematic or block diagram view if the tubing servicing the valve was molded-in. As indicated earlier some EGR's are electrically controlled and signal supply wiring 240 illustrates this possibility. Electrical signals are transmitted through wiring 190 and cable 180. The signal terminates at plug-disconnect 170. Molded-in wiring 240 picks up the electrical signal from plug-disconnect 170 and carries it to EGR socket 200. EGR socket 200 is grounded through molded-in wiring 120 that terminates at disconnect plug 155 and on into grounding wire 150. Like FIG. 1, FIG. 2 can have the grounding wire 120 exit through the cable system 180, not shown. EGR socket 200 would require a totally sealed tubing connection to ensure exhaust gases or vacuum leaks don't occur. Exhaust port 220 is a typical pickup exhaust port opening for the EGR socket 200 to get exhaust gases, channeling the gases through molded-in tubing 210. The EGR, not shown, then controls the amount of exhaust and timing via molded-in tubing 250 through the air intake 100. Other manifold 10 sensing components such as temperature 500, oxygen 900, or gas 950 (not spec. detailed) can similarly be mounted as is the EGR socket 200 without the use of external wiring or hoses draping over the manifold 10. The electrical harness 180 to the intake manifold 10 is designed as an umbilical cord similar to the cables plugged on the back of desk top computers or anyone of the many automobile electrical cable modular connection components/methods. The umbilical electrical harness 180 is also designed to withstand all of those hash conditions that may exist in its environment (heat, gases, fuels, vibrations, etc.). Although the present invention has been described for the embodiment shown in FIG. 1, it is not so limited. For example a vacuum sensor, EGR, or tubing from a fuel injector would have similar molded-in connections, fastening/casting methods per FIG. 2 and manufacturer preference.

Figure 3:
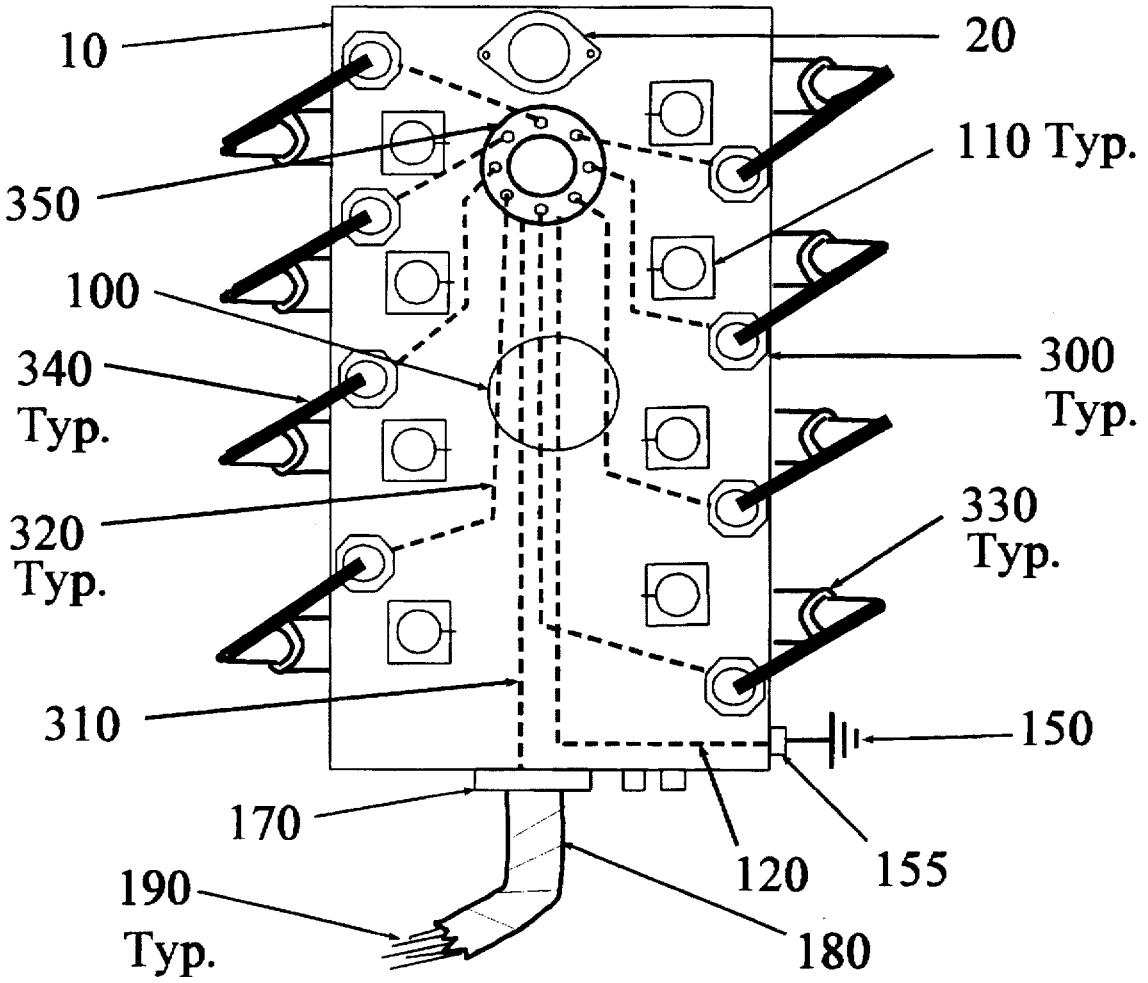
FIG. 3 is a top view block drawing of a manifold showing yet another embodiment of the present invention as it might appear wired for spark plugs.

FIG. 3 is a top view of the molded-in wiring manifold 10 showing what it might look like in schematic block form wired for spark plugs 330. Like FIG. 1 and FIG. 2 specific component details are omitted for clarity. Also identification/numbering of the same components omitted for clarity, anyone versed in reading schematic or block type drawings can comprehend this concept. FIG. 3 illustrates a typical spark ignition wiring arrangement other methods are per manufacturing preferences. The electrical supply wiring 190 weaves through harness cable 180 and terminates at cable disconnect 170. The electrical signal is picked up from cable disconnect 170 and carried by molded-in wiring 310 to the distributor base connection 350. Grounding wire 120 completes the circuit from the distributor base connection 350 to the cable disconnect 155 and on to ground wiring 150.

Like FIG. 1 and FIG. 2 the ground wire 120 may weave through the cable 170, 180, and 190, not shown. High voltage wiring 320 is molded-in the manifold 10 starting at distributor base connection 350 and terminating at lug 300. The high voltage is carried from the lug 300 to the spark plugs 330 via short spark plug wires 340. Unlike existing high voltage ignition wiring that get draped over the manifold 10, my invention requires only short high voltage wiring cables sufficient to connect the lugs 300 with the spark plugs 330. Detailed distributor wiring configurations and type per OEM/manufacturer preference. My invention is to mold-in as much wiring that is possible and in this case, FIG. 3 shows high voltage wiring. Other intake manifold components not shown such as oxygen, temperature, pressure, and exhaust sensors would be similarly configured per FIG. 1, FIG. 2 or FIG. 3. See *Design News* article published 20 May 1996, page 53, showing what my manifold might look like. Note: *Design News* article does not show or describe various tubing application.

Figure 4:
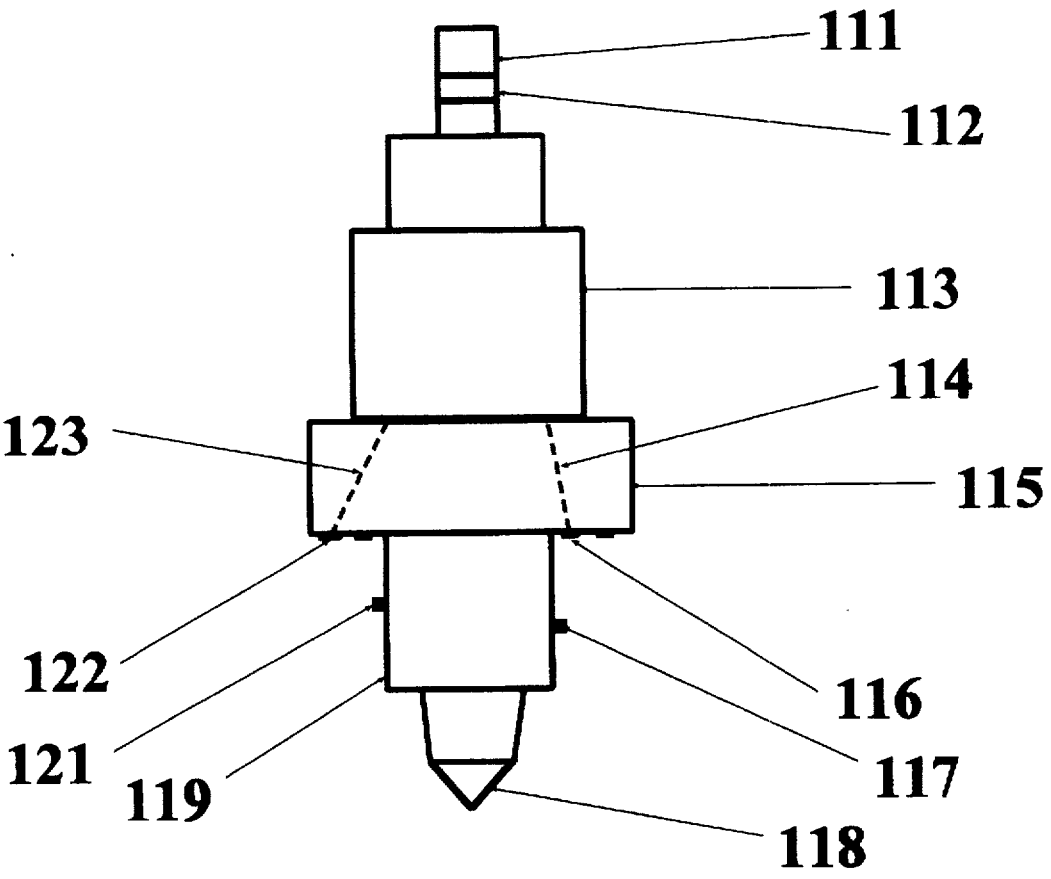
FIG. 4 is a side view block drawing of a fuel injector with concentric electrical contacts with Bayonet type fastening pins.

FIG. 4 is a side view block drawing of what a fuel injector might look like with molded-in wiring 114 and 123 only to be used with manifold 10 of FIG. 1. The fuel connection 111 would remain the same per manufacturer preference with special contours 112 to facilitate fuel hose connections. The solenoid 113 normally wired to a disconnect plug, is shown molded-in as wiring 114 and 123 connected to concentric contacts 116 and 122. FIG. 4*a* shows a bottom view of FIG. 4 detailing contacts 116 and 122. Bayonet 119 securing pins 117 and 121 locks the fuel injector using a quarter turn insertion in injector socket 110, FIG. 1. Fuel injector spray nozzle 118, body 115, are per manufacturer preference.

Figure 5:
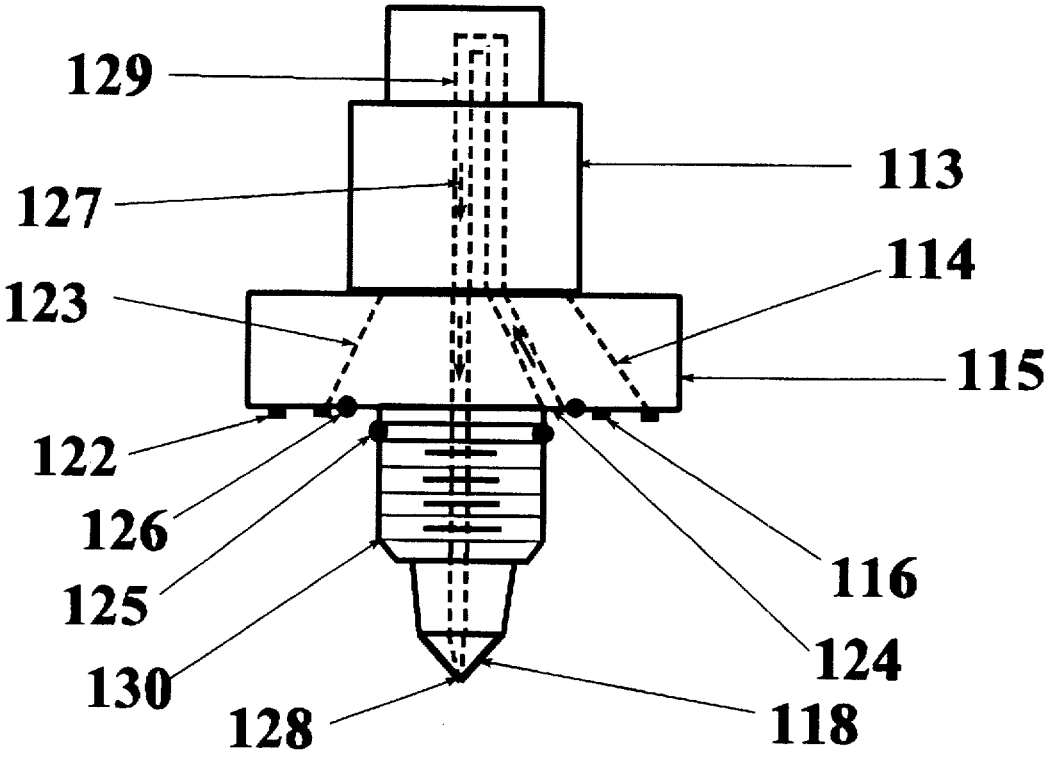
FIG. 5 is another embodiment of fuel injector, FIG. 4, showing a side view block drawing with wiring contacts and fuel supply tubing molded-in the injector.

FIG. 5 is another embodiment of a fuel injector showing molded-in wiring 114, 123 and molded-in fuel tubing 129 in block drawing. The electrical concentric contacts 116 and 122, not shown with bottom view, are similar in appearance to FIG. 4*a*. Fuel entrance 124 is a concentric groove on the intake manifold or injector that channels the fuel through molded-in tubing 129 per fuel direction arrows 127 and exists through nozzle 128. All internal valve controls (solenoid, valve seat etc.) deleted to clarify molded-in wiring 114, 123 and tubing 129 only. O-rings (packing, preformed) 125, 126 and threaded fastening body 130 required to ensure a fuel safe condition. Other threaded fastening methods are per manufacturer preference.

Figure 6:
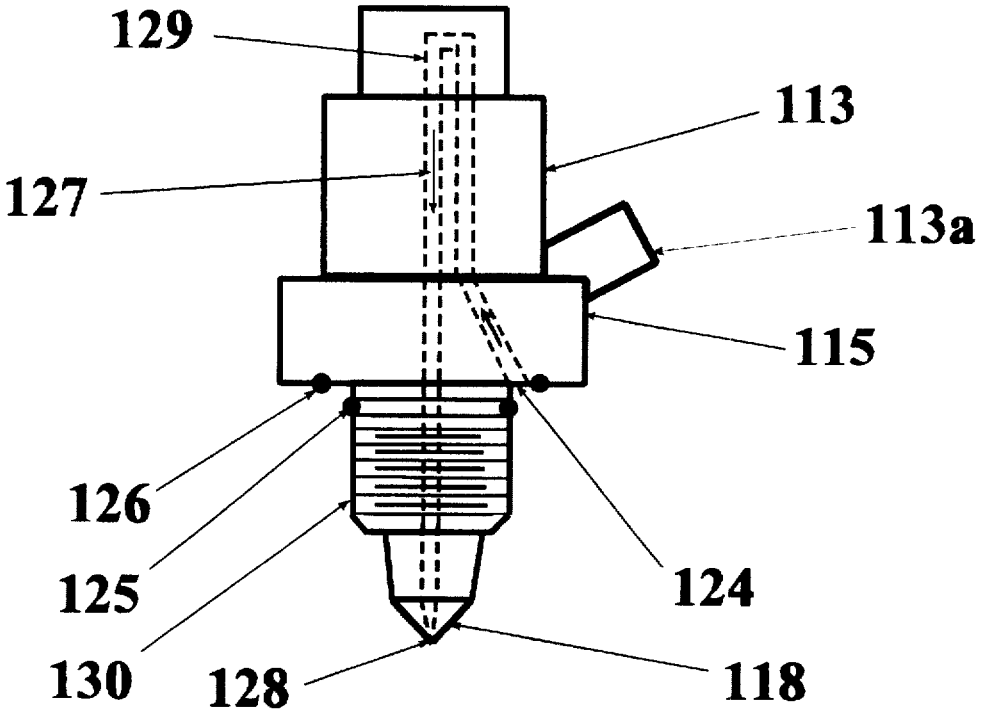
FIG. 6 is still another embodiment of fuel injector, FIG. 4, showing a side view block drawing with only fuel supply tubing molded-in the injector.

FIG. 6 is yet another embodiment of the fuel injector but in this side view block drawing it only shows molded-in fuel tubing 129. All other fuel and tubing conditions/descriptions are similar to FIG. 5 and details. Electrical contact is per existing standard injector side connectors 113*a*. Internal wiring not shown because FIG. 6 drawing is about internal fuel supply tubing and solenoid wiring remains the same per existing OEM design. Also intent of this drawing is not to educate on the internal workings of an injector solenoid/valve mechanics. Fuel supply of FIG. 6 is from molded-in tubing from the intake manifold verse existing methods of supplying fuel via a nipple connection normally located at the top of the injector. The fuel enters through opening 124 and is sprayed out through nozzle opening 128.

Figure 7:
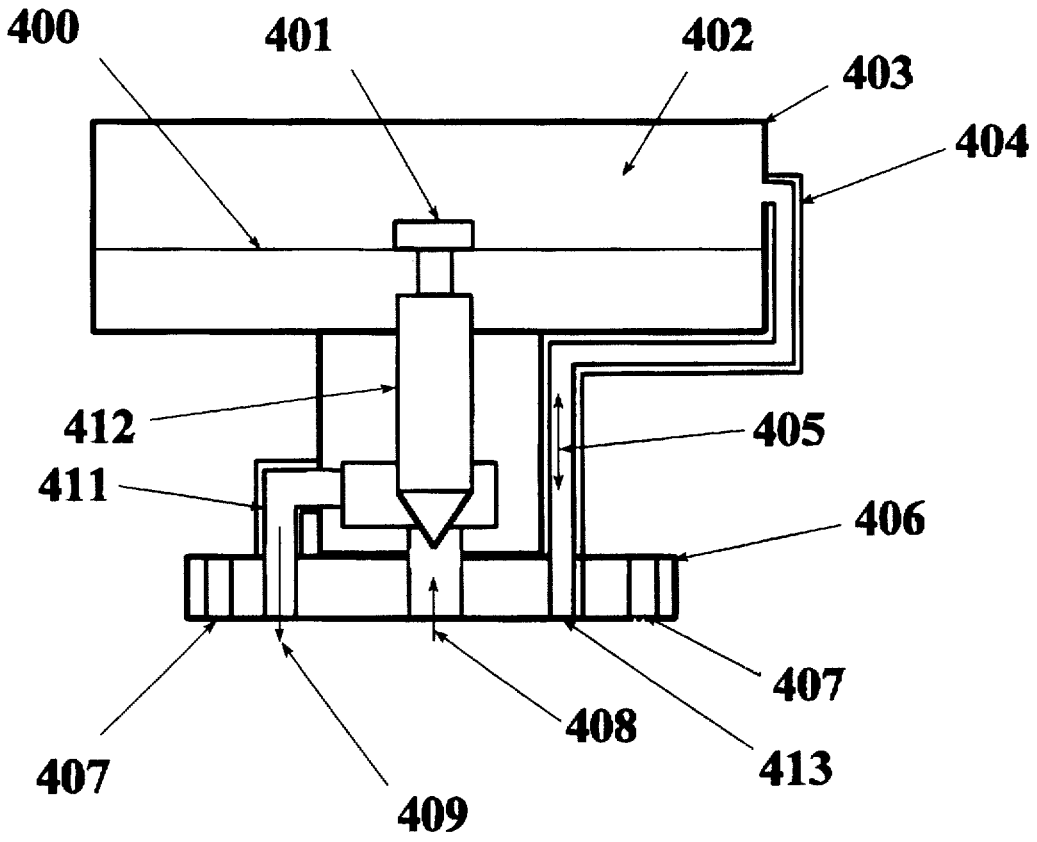
FIG. 7 is a side view block drawing of an Exhaust Gas Recirculating (EGR) valve with molded-in vacuum tubing.

FIG. 7 is a side view block drawing of what an Exhaust Gas Recirculating (EGR) 403 valve might look like for a molded-in manifold 10, FIG. 2, with molded-in vacuum tubing. To clarify some of the molded-in tubing, FIG. 7 is a cut away view slicing from the top to the bottom of a concentric EGR. The main EGR housing 403 encloses a vacuum chamber 402 by which a vacuum source per direction arrow 405 is channeled via molded tubing 404 from an inlet 413 at the base mounting flange 406. Mounting and locating holes 407 secure the EGR 403 to the intake manifold 10, FIG. 2, in the EGR socket 200. Exhaust gases enter through inlet 408 and are throttled with valve plug 412 and seat, not shown. Exhaust gas flows directions' shows the inlet 408 from the exhaust manifold via gas passage 411 and outlet 409 to intake manifold 10 molded-in tubing 250, FIG. 2. Valve plug 412 is secured to diaphragm 400 with fastener 401. Specific details of the various internal components and operation omitted to clarify molded-in tubing aspects of this invention. Although not shown in FIG. 7, an electrical solenoid/motor control valve can be incorporated into molded-in vacuum tubing 404 to further fine tune vacuum signals. Specific manufacturing details (mounting, internal etc.) of the EGR 403 valve is per manufacturer preference. The intent of FIG. 7 is to show how an EGR valve might look like with molded-in tubing instead of existing EGR valve with tubing draped over the intake manifold.

Figure 8:
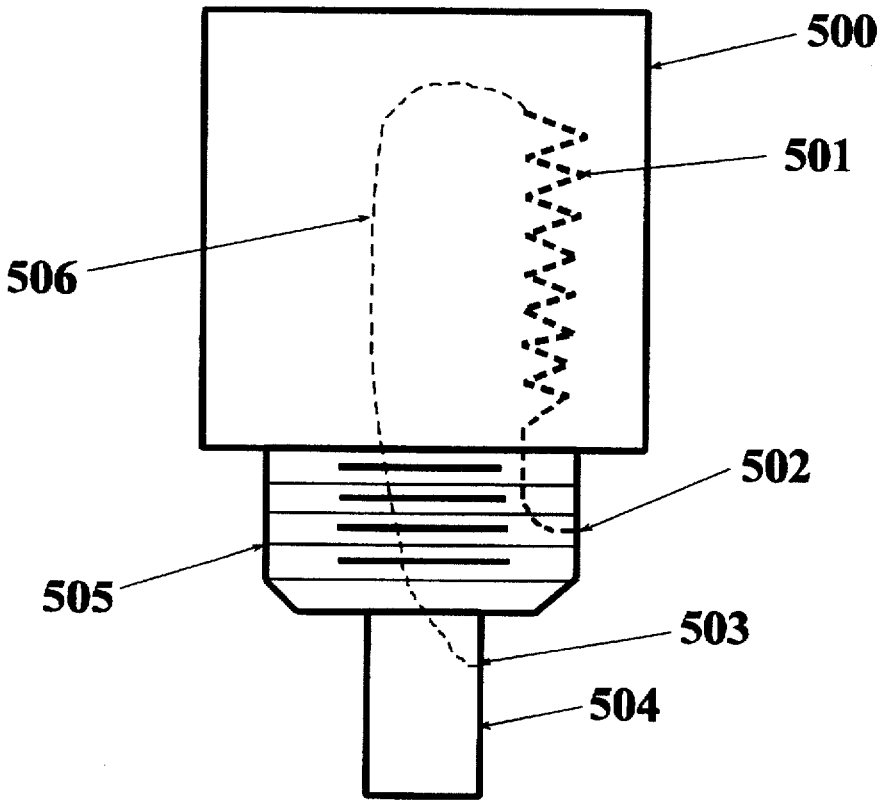
FIG. 8 is a side view block drawing of a temperature sensor with molded-in wiring contacts.

FIG. 8 is side view block drawing of what a temperature sensor might look like with molded-in wiring 502 and 503. Unlike existing temperature sensors with external cable plug connections, my invention achieves the electrical connection via temperature probe 504 and threaded base contact 505 similar to any one of the many light bulb types. Housing enclosure 500, nonresistance element 501 and internal wiring is per manufacturing preference. The intent of FIG. 8 is to show a screw in type temperature sensor that connects to an external electrical source via a threaded base applicable to a molded-in wiring manifold 10, FIG. 2. Unlike any existing temperature sensors with electrical base connection this invention is specific to internal combustion engine intake manifolds and specifically molded-in wiring manifolds.

Figure 9:
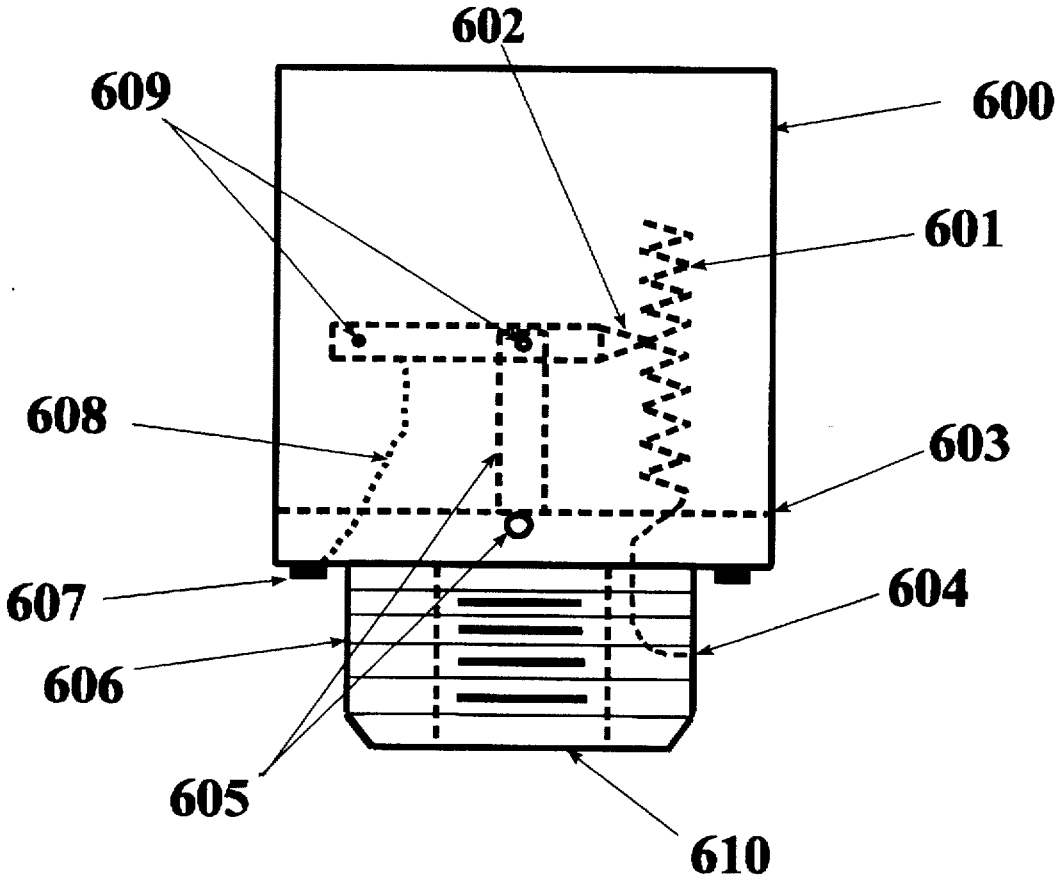
FIG. 9 is a side view block drawing of a pressure/vacuum sensor with molded-in wiring contacts.

FIG. 9 is a block side view of a cylindrical pressure/vacuum sensing device 600 with molded-in wiring connected/wired to threaded base 606 at the point 604 and concentric contact 607. Vacuum or pressure is through an opening 610 that causes diaphragm 603 to deflect. The deflection of diaphragm 603 moves arm assembly 605 that in turn causes pickup arm 602 to pivot on pins 609. The up and down movement of pickup arm 602 causes the total resistance of the wiring to vary accordingly. Wiring 608 shows how it might look wired from the pickup arm 602 to the concentric contact 607. The base 606 is threaded to insure a pressure/vacuum seal. FIG. 9 is applicable to manifold vacuum sensors, oil pressure sensors or manifold pressure sensors. Specific details and operation are per manufacturer preference.

Figure 10:
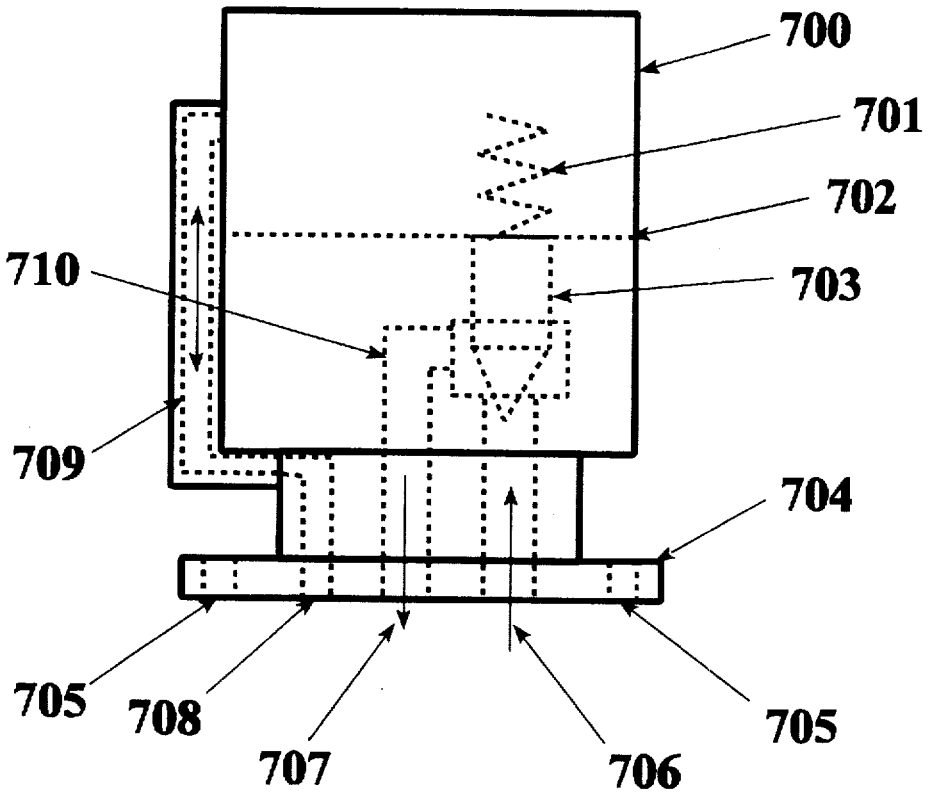
FIG. 10 is a side view block drawing of a fuel pressure regulating/relief valve showing molded-in tubing.

FIG. 10 is side view block drawing of a fuel pressure regulating/relief valve 700 with molded-in tubing applicable to manifold 10 per FIG. 1. Relief valve 700 would install in molded-in socket 140, FIG. 1. Per FIG. 10 the fuel flow is depicted with arrow 706 suggesting fuel supply under pressure and arrow 707 is the fuel discharge or fuel return. Fuel flow through the relief valve is through molded-in tubing passages 710 and controlled by valve 703 under spring pressure 701. Variation in fuel pressure is achieved by deflecting diaphragm 702 that is deflected from a vacuum source through molded-in tubing 709. The vacuum source is supplied through the base flange 704 opening 708. Flange mounting is achieved through locating and mounting holes 705. Specific details and operation of relief valve per manufacturer preference.

Figure 11A:
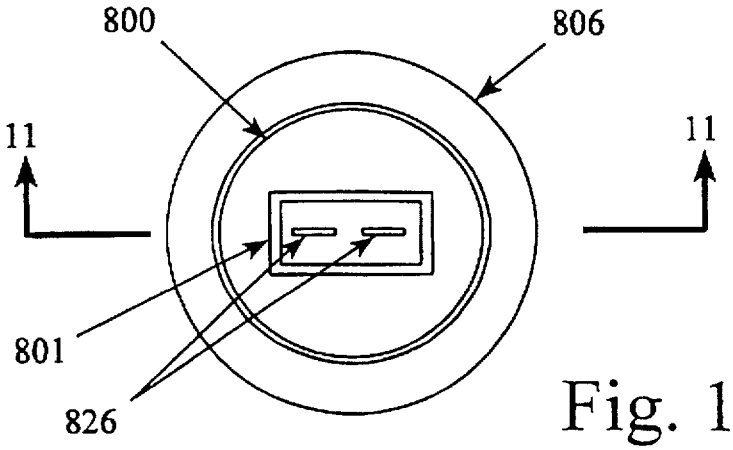
FIG. 11*a* is a top view block drawing of a quick disconnect fuel injector.
Figure 11:
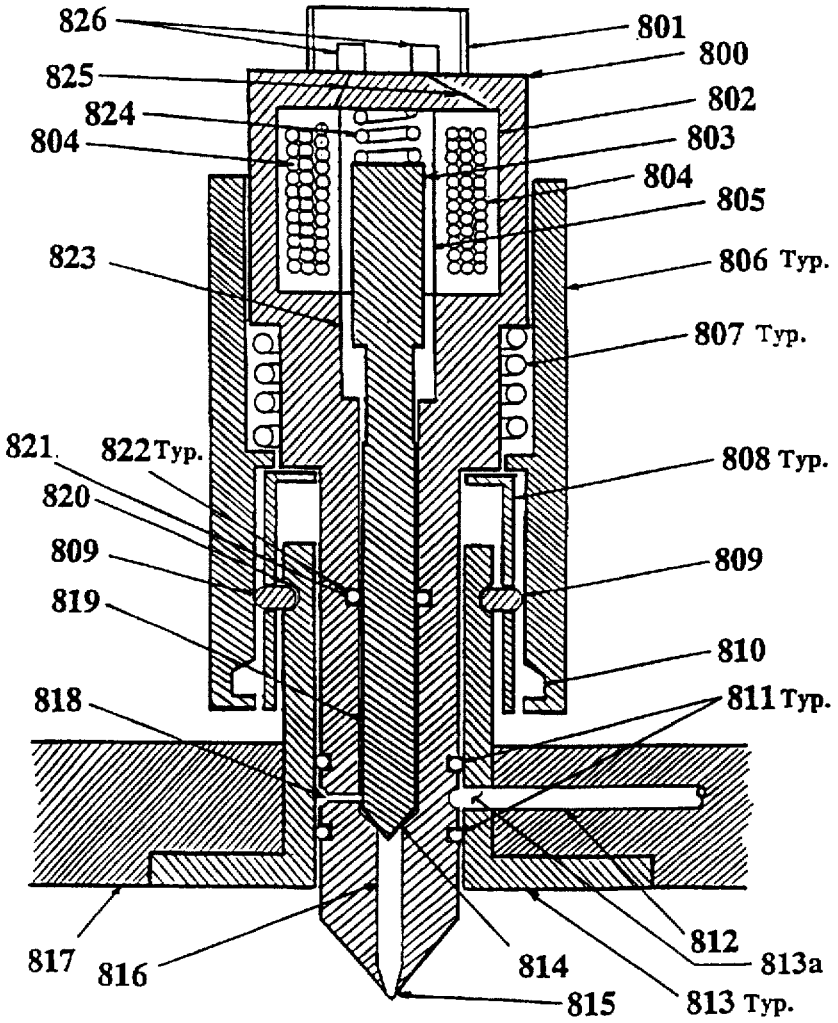
FIG. 11 is a block drawing view on a plane passing through the line A—A looking in the direction of the arrows illustrated in FIG. 11*a* showing a quick disconnect fuel injector.
Figures 12, 13:
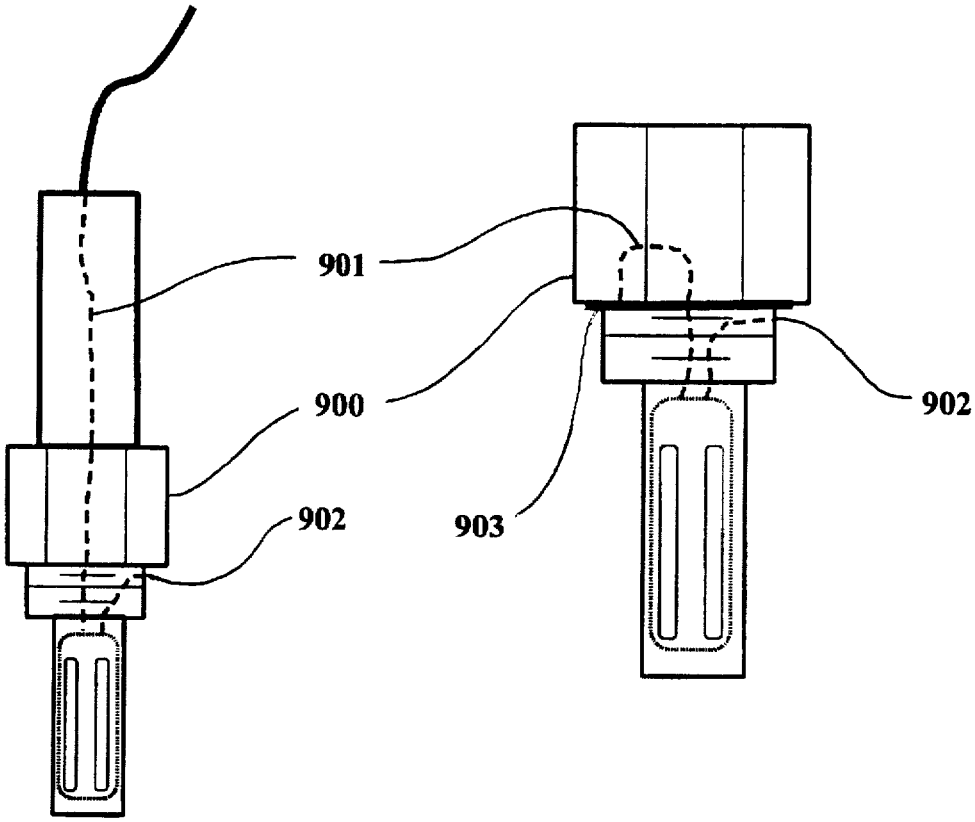
FIG. 12 is a side view of a typical oxygen sensor with pigtail wire lead.
FIG. 13 is a side view of an oxygen sensor for a female threaded socket wiring application.
Figure 14:
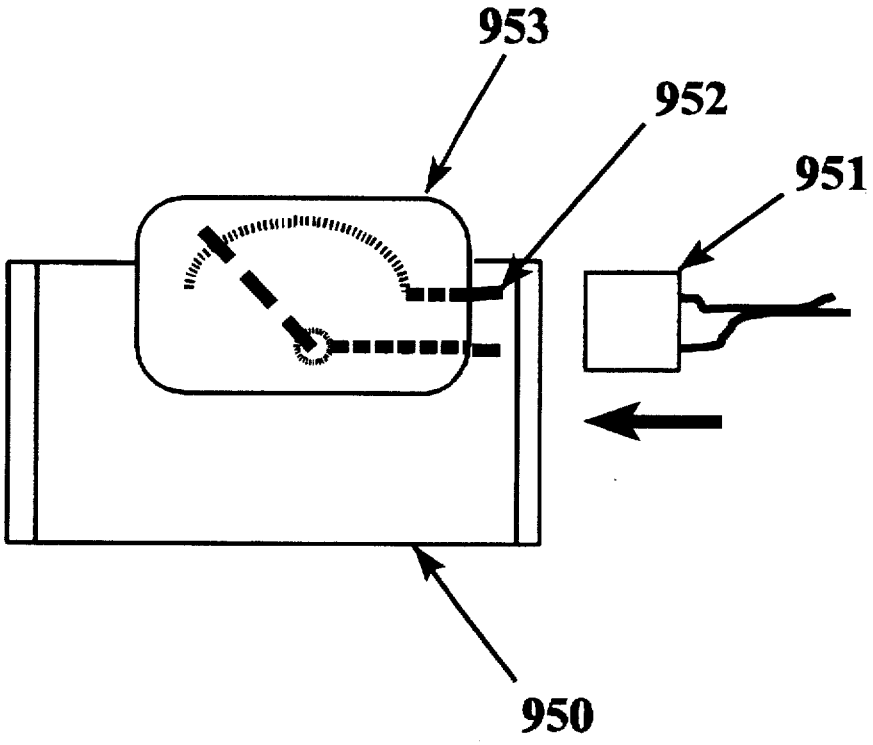
FIG. 14 is a gas sensor with external wiring connector.
Figure 15:
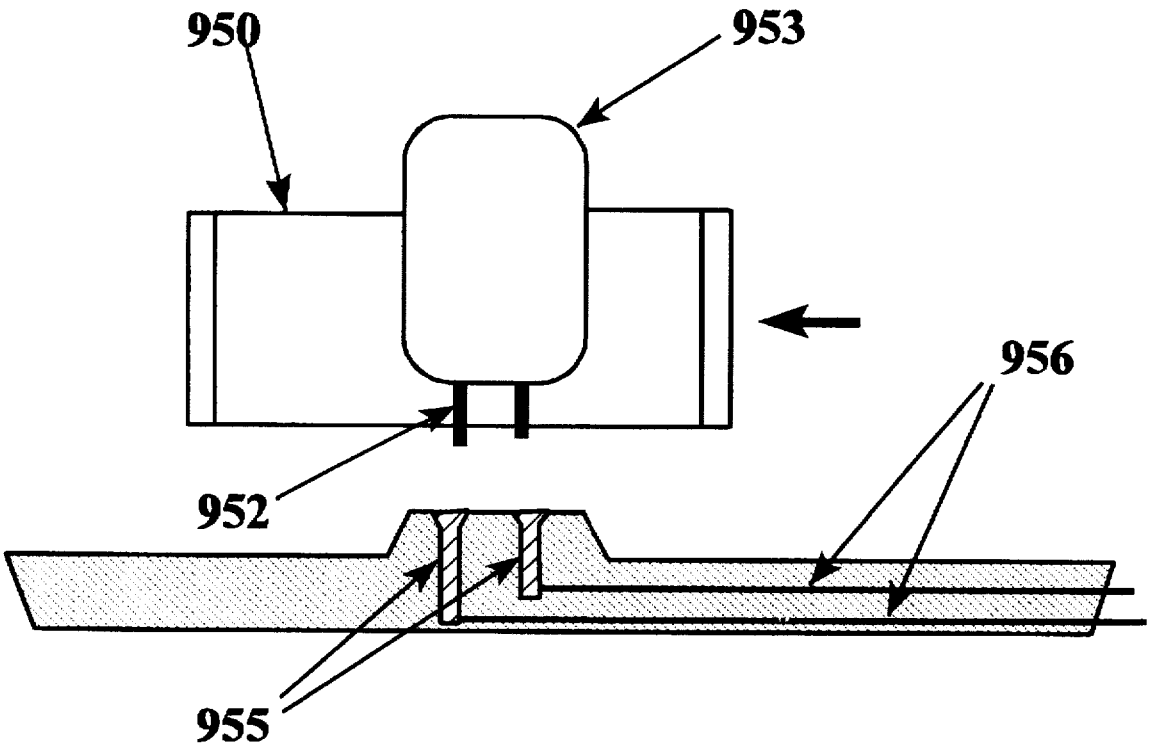
FIG. 15 is a gas sensor for molded-in wiring application.

FIG. 11 is another embodiment of what a quick disconnect fuel injector might look like. FIG. 11 is a cut-away view of top view FIG. 11*a* showing in block drawing the internals of the injector. The drawing is supplied to show that a quick disconnection fuel injector is possible using hydraulic hose coupling methods.

Looking at FIG. 11, 817 is a partial cross section view of my intake manifold showing a molded-in male coupling 813. The male coupling 813 is coupled to the fuel injector 800. The locking mechanics between the two pieces is achieved using locking pins 809 which engage into a circular groove 820 located on the outside diameter of the male coupling 813. The locking pins are released by lifting up the female coupling locking sleeve 806 away from the manifold which compresses spring 807. Once lifted the locking pins 809 have sufficient area 810 away from the female coupling groove 820 to disengage and release the female injector coupling 806. The locking pins 809 float within a cylindrical sleeve 808 located between the male coupling 813 and female coupling 806.

The control of fuel (opening and closing) of the quick disconnect fuel injector 800 is achieved using existing solenoid methods. FIG. 11 and FIG. 11*a* illustrates this by showing typical solenoid components such as the return spring 824, electrical plug connections 826, solenoid coil 804, electrical plug connector 801 with contacts 826 and iron actuation rod 803. This specifications with FIG. 11 and 11*a* is not to describe how the mechanics or electronics of a typical fuel injector works that will be readily apparent to those skilled in the art in light of the teachings. The intent of this drawing is to illustrate quick disconnection and fuel supply without external hoses is possible in a fuel injector.

Molded-in tubing/passages 812 supplies the fuel to the quick disconnect fuel injector through opening 813*a* via injector circular groove and passage 818. The fuel is controlled by valve plug 819/seat 814, flows through valve base opening 816 and exits through spray nozzle opening 815. Fuel pressure from molded-in tubing/passages 812 is prevented from leaking between the injector 800 and male coupling using preformed packing, O-rings 811 which are located on either side of the injector circular groove 818. Preformed packing, O-ring 821 prevents the fuel from escaping between the sliding valve plug 819 and injector 800. Note: spray nozzle and fuel injector details not shown due to the many variations of the injector mechanics and electrical wiring per manufacture preference and FIG. 11 illustrates only one method.

The advantages of the present design are many:

1. Reduced assembly time—molded-in electrical wiring and tubing eliminate having to locate and identify terminal connections for each component. Harnesses are simply plugged-in.
2. Reliability—less chance of wires short circuiting or tubing breaking down from high temperatures.
3. Increased shock proof—less chance for the wiring or tubing to come apart from vibration.
4. Reduced weight—the overall length of wiring and tubing is reduced. No wiring or tubing looms required.
5. Reduced manufacturing cost—less material used to manufacture an intake manifold as well as less time to plug-in one cable verses individual terminal component connections.
6. Reduced overall size—no externally draped wiring, tubing and wiring/tubing restraints required.
7. Additionally, the new features of this design is the elimination of external tubing and electrical wiring. Electrical wiring is either molded within the manifold or produced in printed circuit board form. Less skill would be required to disassemble and reassemble an engine. There would not be a need to tag removed hoses or wiring for reassemble as they would no longer exist. The added advantage of having hoses molded within the manifold allows a more reliable heat resistant structure. Electrical wiring would be much more difficult to breakdown from open circuits or fray caused by heat or vibrations.

Although the invention has been described relative to specific embodiments thereof, there are numerous other variations and modifications that will be readily apparent to those skilled in the art in the light of the above teachings. For example, while the appearance of the intake manifold 10, FIG. 1, appears to look like an early form of cast metal manifold it is by no means restricted to that simple style manifold. It is therefore to be understood that, within the scope of the appended claims, the invention may be practiced other than as specifically described.

What is claimed is:

1. An internal combustion engine one piece fuel and air intake manifold made of plastic, comprising: integrally molded-in electrical wiring via which electrical control is made available to an electrical temperature sensor installed on said manifold, said molded-in wiring extends within said manifold from an electrical harness connecter at one end of said manifold, and from there to a molded-in electrical temperature socket, said socket being disposed in a molded-in through socket hole structure such that the electrical contact surfaces are communicated with the molded-in electrical wiring by means of an electrical connector in hole opening lending into the manifold air plenum area, wherein said temperature sensor socket comprises securing means with at least one conductive element that is engaged with a corresponding securing catch-receiving means in said electrical temperature sensor adjacent said through socket hole structure.

2. An air intake manifold as set forth in claim 1 wherein additional separate molded-in wires services a socket for a gas sensor.

3. An air intake manifold as set forth in claim 1 wherein additional separate molded-in wires services a socket for a pressure sensor.

4. An air intake manifold as set forth in claim 1 wherein additional separate molded-in wires service a plurality of fuel injector sockets.

5. An air intake manifold as set forth in claim 1 wherein additional separate molded-in wires services a socket for an exhaust gas recirculating valve.

6. An air intake manifold as set forth in claim 1 wherein additional separate molded-in wires services a socket for high voltage ignition distributor system.

7. An air intake manifold as set forth in claim 1 wherein additional separate molded-in wires services a socket for an oxygen sensor.

8. An air intake manifold as set forth in claim 1 wherein, comprising: integrally molded-in tubing via which fuel is made available in a series run to a plurality of fuel injectors mounted on said manifold, said molded-in tubing extends from a first tube fitting supply connector at one end of said intake manifold for a supply hose hook up, and from there the tubing extends in series from one molded-in injector socket to another and exiting said manifold at a second fuel return hose fitting connector, said injector socket being disposed in a corresponding through socket hole structure such that the fuel is communicated with molded-in tubing through socket connector in hole opening leading into the manifold plenum, wherein said fuel injectors comprises securing means that are engaged with a corresponding securing means in said intake manifold adjacent said through socket holes.

9. An intake manifold according to claim 8, wherein a socket for a device for regulating the pressure of the fuel supplied to the injectors is installed in with the injectors tubing run within said manifold.

10. An air intake manifold as set forth in claim 1, comprising: integrally molded-in tubing via which air pressure within said manifold plenum is made available to a pressure sensor socket, said pressure sensor socket being disposed in a corresponding through socket hole structure such that the air pressure is communicated with molded-in tubing through socket connector in hole opening leading into the manifold air supply plenum, wherein pressure sensor comprises securing means that is engaged with a corresponding securing means in said intake manifold adjacent said through socket hole structure.

11. An air intake manifold as set forth in claim 1, comprising: integrally molded-in tubing via which air supply is communicated to a socket within said manifold to a vacuum operated motor, said socket being disposed in a corresponding through socket hole structure such that the air is communicated with molded-in tubing through socket connector in hole opening leading into the manifold air supply plenum said socket being open in a direction that faces the motor air supply opening and mated with the corresponding molded-in tubing socket to establish air supply communication of the said motor, wherein said motor comprises securing means that is engaged with a corresponding securing means in said intake manifold adjacent said through socket hole structure.

12. An air intake manifold as set forth in claim 1, comprising: integrally molded-in tubing via which plenum air supply is communicated to a receptacle width said manifold to an exhaust gas recirculating valve, said receptacle being disposed in a corresponding through socket hole structure such that the plenum air and exhaust gases is communicated with molded-in tubing through socket receptacle connector in holes leading into the manifold air supply plenum, said receptacle being open in a direction that faces the exhaust gas recirculating valve and mated with the corresponding molded-in tubing receptacle to establish plenum air communication to the exhaust gas recirculating valve motor and exhaust gases to the exhaust gas recirculating valve valve, wherein said exhaust gas recirculating valve comprises securing means that is engaged with a corresponding securing receiving means in said intake manifold adjacent said through socket hole structure.

13. An air intake manifold as set forth in claim 1, comprising: integrally molded-in tubing via which fuel is made available in a series run to a plurality of quick disconnect fuel injectors mounted on said manifold, said quick disconnect is a push and pull mechanism utilizing one hand connection and disconnection, said molded-in tubing extends from a first tube fitting supply connector at one end of said intake manifold for a supply hose hook up, and from there the tubing extends in series from one molded-in quick disconnect injector socket to another and exiting said manifold at a second fuel return hose fitting connector, said quick disconnect injector socket being disposed in a corresponding through socket hole structure such that the fuel is communicated with molded-in tubing through socket connector in hole opening leading into the manifold plenum, wherein said fuel injectors comprises quick disconnect securing means that are engaged with a corresponding securing means in said intake manifold adjacent said through socket holes.

* * * * *